US005520091A

United States Patent [19]

Chromik

[11] Patent Number: 5,520,091

[45] Date of Patent: May 28, 1996

[54] HYDRAULICALLY COUPLED POSITION LOCKING DEVICE FOR SURGICAL TABLES

[75] Inventor: Karel Chromik, Schliern b. Köniz, Switzerland

[73] Assignee: American Sterilizer Company, Erie, Pa.

[21] Appl. No.: 24,654

[22] Filed: Mar. 1, 1993

[51] Int. Cl.[6] ..... F15B 15/26

[52] U.S. Cl. ..... 91/44; 91/420; 92/21 R

[58] Field of Search ..... 91/41, 42, 44, 91/420, 421, 461; 92/21 R, 21 MR, 27, 28, 29

[56] References Cited

U.S. PATENT DOCUMENTS

| | | | |
|---|---|---|---|
| 3,814,414 | 6/1974 | Chapa . | |
| 3,820,176 | 6/1974 | Feiertag . | |
| 3,896,704 | 7/1975 | Barud et al. . | |
| 4,116,113 | 9/1978 | LeClerc | 91/44 X |
| 4,524,676 | 6/1985 | Rogers | 91/44 X |
| 4,669,136 | 6/1987 | Walters et al. . | |
| 4,691,393 | 9/1987 | Kuck . | |
| 4,784,037 | 11/1988 | Fabyan et al. | 91/44 X |
| 4,802,401 | 2/1989 | Osaki | 91/44 |
| 4,865,303 | 9/1989 | Hall . | |
| 4,912,787 | 4/1990 | Bradcovich . | |
| 4,959,957 | 10/1990 | Schmale et al. . | |
| 5,036,750 | 8/1991 | Katayama | 91/420 X |
| 5,063,624 | 11/1991 | Smith et al. . | |
| 5,116,032 | 5/1992 | Strachon . | |
| 5,136,929 | 8/1992 | Kervagoret | 91/420 |
| 5,204,059 | 5/1993 | Schexnayder | 91/461 X |

*Primary Examiner*—Edward K. Look
*Assistant Examiner*—Hoang Nguyen
*Attorney, Agent, or Firm*—Jones, Day, Reavis & Pogue

[57] ABSTRACT

An auxiliary mechanical position locking device is coupled to the hydraulic system that motivates a double acting piston for positional control of surgical tables. The combination of hydraulic coupling and mechanical locking maintains positional stability of the surgical table and insures against sudden or precipitous movements.

11 Claims, 9 Drawing Sheets

HYDRAULICALLY COUPLED POSITION LOCKING DEVICE FOR SURGICAL TABLES

BACKGROUND OF THE INVENTION

This application involves an improvement to the design of hydraulically motivated surgical tables. The invention is particularly applicable to surgical tables used in hospital operating rooms, although it will be appreciated that the invention has broader applicability to any task demanding precision positional control of a live subject or inanimate workpiece. Other possible applications include, without limitation, dentists' chairs, and veterinary equipment.

Surgeons have, in recent years, employed operating tables capable not only of vertical adjustment, but also tilting the plane of the operating table to various degrees of pitch or yaw about the central axes. Hydraulic control systems have been employed to achieve a continuous adjustment of a patient's body position to accommodate the ergonomic needs of the surgeon, and the demands of the surgical procedure employed.

The basic design of such tables features a double-acting hydraulic cylinder that extends and retracts to adjust the position of the table surface. The cylinder moves to its desired position by means of pilot operated check valves that deliver hydraulic fluid to either side of the cylinder. When the cylinder arrives at its desired position, this position is maintained by back pressure against the check valves.

When the check valves leak, however, one of two undesirable things can occur. First, the hydraulic pressure could be lowered on the side of the cylinder with the leaky valve, causing the table to shift under its load. Second, if the load were balanced, the fluid could leak out of one side, leaving only low pressure, compressible air. Then, when the balance of forces shifted, the table could suddenly fall in one direction or the other.

An early attempt at a solution to the foregoing problem was the addition of an auxiliary mechanical locking device. When the locking device was manually released, however, a sudden movement could result from a pre-existing hydraulic pressure imbalance. Thus, it is desirable to have mechanical locking capability to maintain a selected position despite leaky check valves, but which provides smooth movements when the hydraulic system is next activated.

SUMMARY OF THE INVENTION

The present invention provides a locking mechanism that includes a position locking device that is mechanically biased to prevent movement of the main piston rod, which positions the table surface. The bias is overcome by means of hydraulic coupling with the fluid activation system that moves the main piston in the double acting hydraulic cylinder. This hydraulic coupling provides an auxiliary position locking device that is maintained in its locking position until the hydraulic system has been fully resupplied with fluid.

In a preferred embodiment, the position locking device consists of a free-running thread on the main piston rod, mated with a rotating nut that is seated between thrust bearings. The outer periphery of the nut has very small gear teeth. In normal operation, the hydraulic pressure urges the threaded piston rod in the desired direction through the nut, which rotates in response to the force against the threads. When hydraulic pressure is removed, however, a rod capped with a gear section advances until it meshes with the gear teeth on the rotating nut. All rotation of the nut, and hence, all movement of the main piston rod is stopped while the position locking device is engaged. The mechanical position lock is removed when the hydraulic pressure is restored, overcoming the mechanical bias that urges the rod and gear section into engagement with the rotating nut.

DESCRIPTION OF PREFERRED EMBODIMENT

Figure 1:
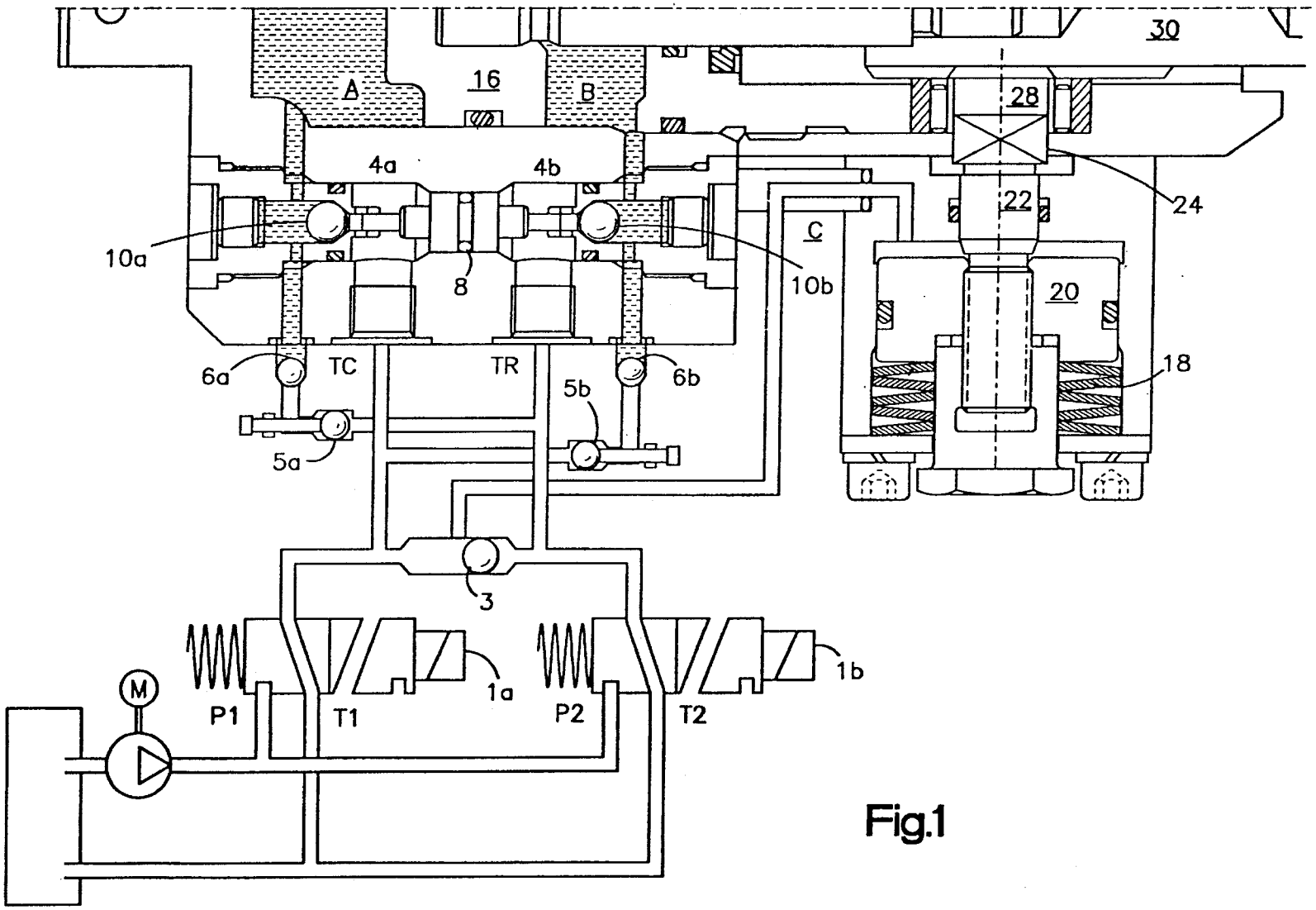
FIGS. 1–5 are cross-sectional side views of the invention, shown in combination with a hydraulic control system, that illustrate the operation sequence of extending the main piston.

The function of the invention will be described assuming the operator desires to extend the main piston. Referring to FIG. 1, the invention and control system are shown at rest before any external hydraulic pressure is applied. The main piston is locked hydraulically by back pressure against check valves 6A and 6B and 10A and 10B, and mechanically by the position locking device 18, 20, 22, 24, 28 and 30.

The main hydraulic piston 16 is advanced by increasing the hydraulic pressure in Chamber A and decreasing the hydraulic pressure in Chamber B. The threaded piston rod 30 can advance only when the toothed nut 28 is allowed to rotate. In the resting position shown in FIG. 1, however, the rotation of the toothed nut 28 is arrested by the meshing gear section 24. This gear section is urged into engagement with the toothed nut by a second piston 20 and its associated piston rod 22, which are acted upon by the force of the belleville springs 18.

Figure 2:
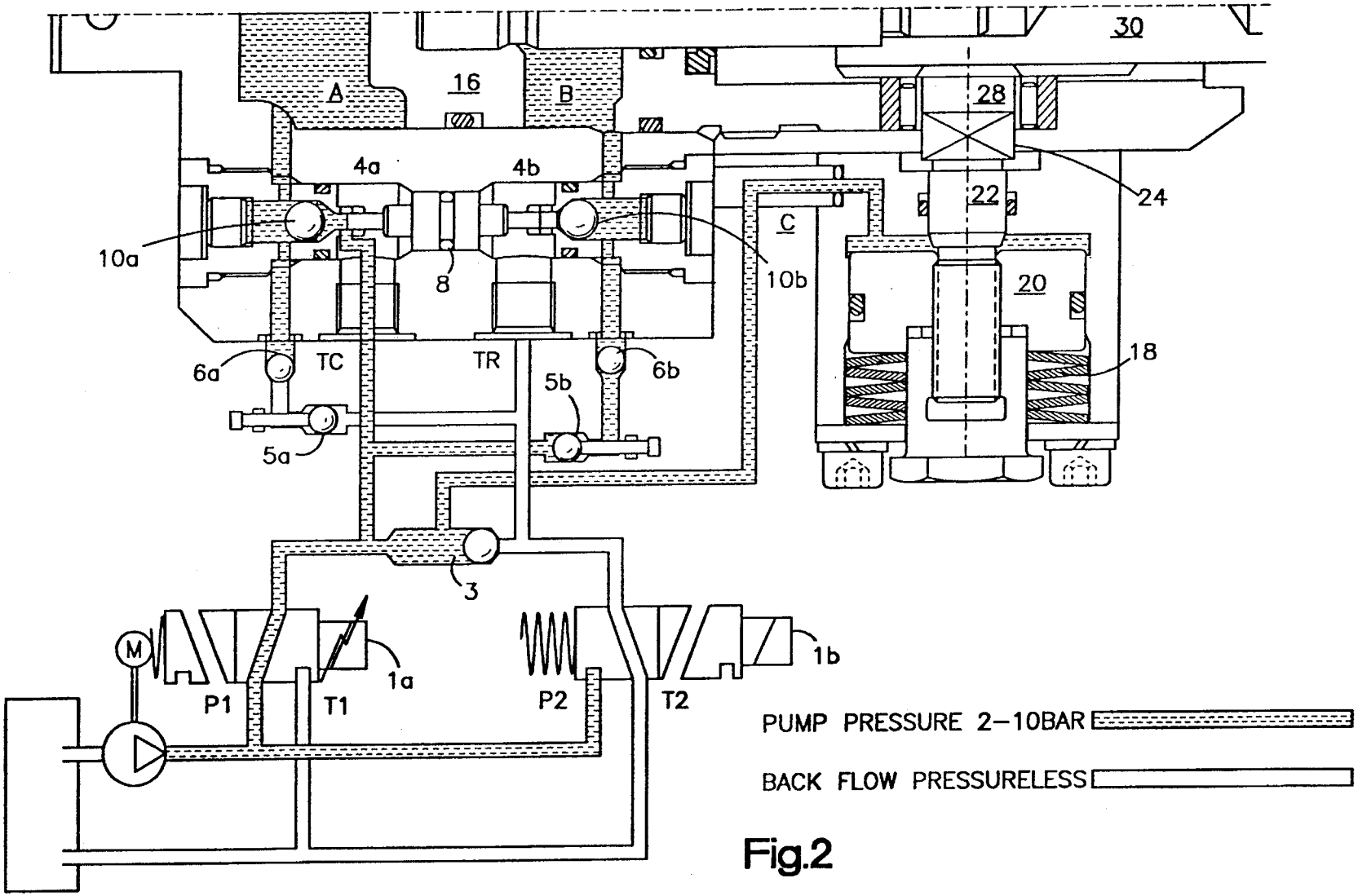

Referring to FIG. 2, the first step in extending the main piston occurs when solenoid valve 1A is energized, and the hydraulic pump motor M is started. The TC line is pressurized, while the TR line is still drained through valve 1B, which remains in its de-energized position. The incoming hydraulic fluid initially flows in three directions. First, it flows through orifice 4A and its associated check valve 10A to the extending chamber A of the main piston 16, overcoming the approximately 2 bar opening pressure of valve 10A. Second, it flows through valve 5B and its associated check valve 6B into the retracting chamber B of the main piston 16, overcoming the approximately 2 bar opening pressure of valve 6B. The two chambers of the main cylinder are thus prefilled with hydraulic fluid of equal pressure before any movement takes place. This prefilling avoids any sudden or precipitous movements at the moment when the position locking device is released to start the desired extension movement. Third, the fluid flows through valve 3, which is now shut in direction of TR, to the piston 20 that actuates the mechanical locking rod 22. The locking rod is mechanically biased to prevent movement of the main piston rod 30, by means of belleville springs 18 with an initial force of 500 lbs, corresponding to approximately 20 bar of hydraulic pressure on piston 20. Consequently, this second piston does not yet move.

Figure 3:
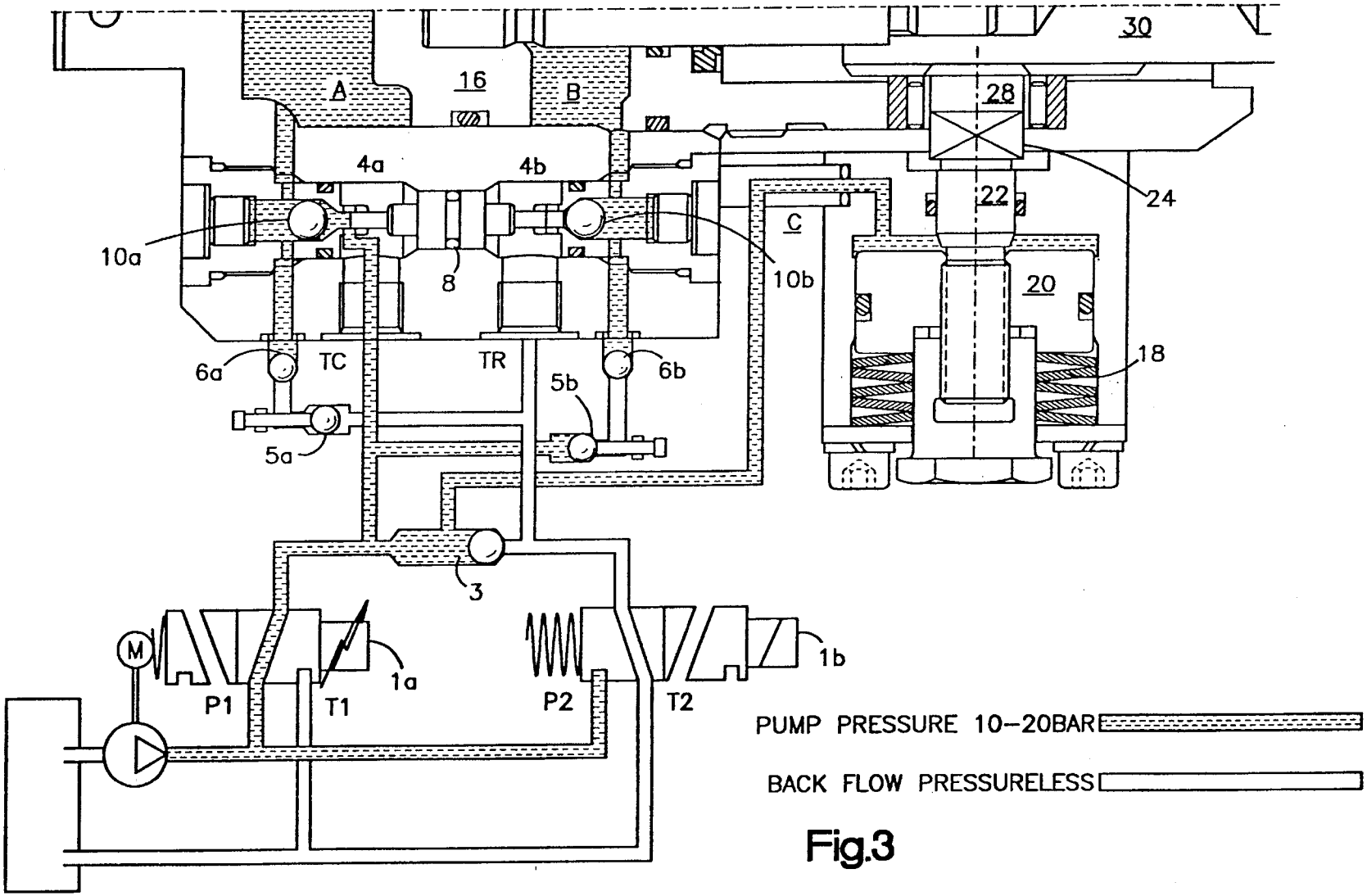

Referring to FIG. 3, the second step in extending the main piston occurs beginning at approximately 10 bar hydraulic pressure. The spring loaded filler valve 5B is actuated by rising fluid pressure and brought to its closed position at 10 bar. Thus, the fluid flow into chamber B is shut off and a pressure of 10 bar maintained there. Consequently, fluid pressure continues to rise in chamber A only, causing an increasingly unbalanced force on piston 16. The valve piston 8 begins moving towards side B against the force of its centering spring, which requires 30 bar pressure for full movement. Some fluid is being displaced by piston 8 into the TR line.

Figure 4:
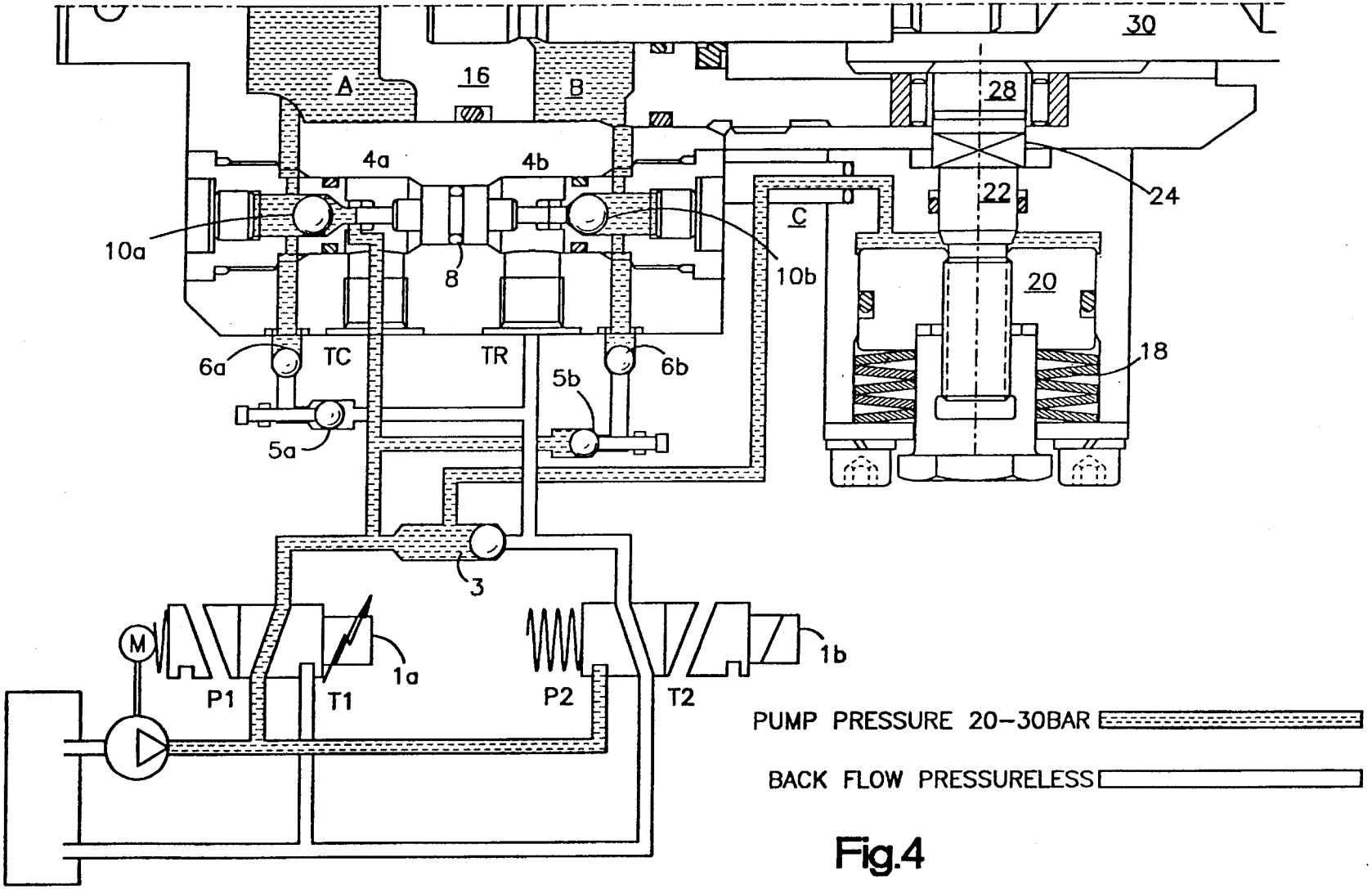

Referring to FIG. 4, the third step in extending the main piston occurs beginning at approximately 20 bar hydraulic pressure. The continuous pressure overcomes the mechanical bias and moves the piston 20 of the position locking device so as to disengage the lock. At the same time, the stem of the B side of the valve piston 8 has entered the throttling bore of valve cartridge 4B and is in contact already with check valve ball 10B. Main piston 16 is still held hydraulically in its position by counterpressure building up in chamber B.

Figure 5:
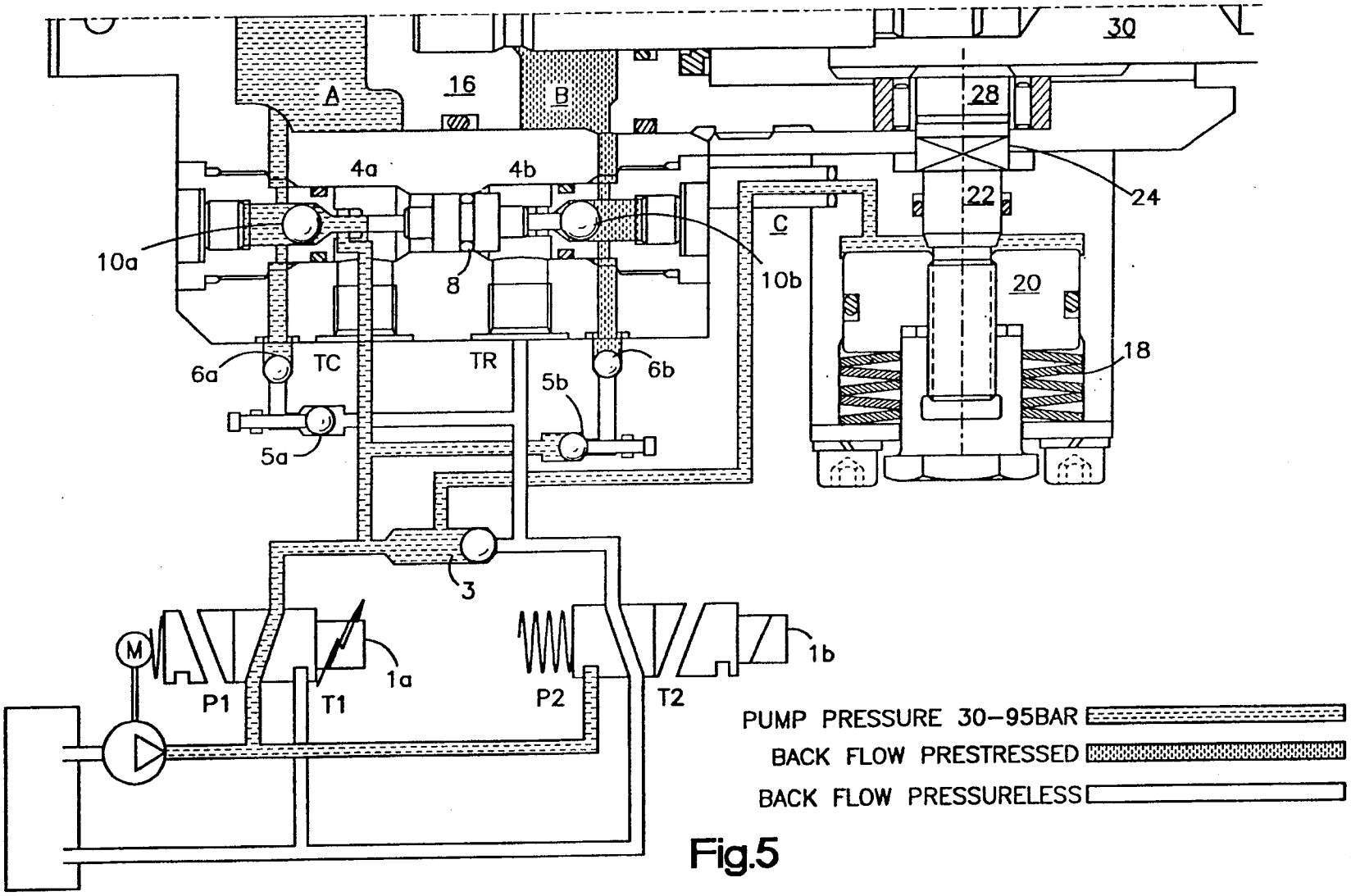
Figure 6:
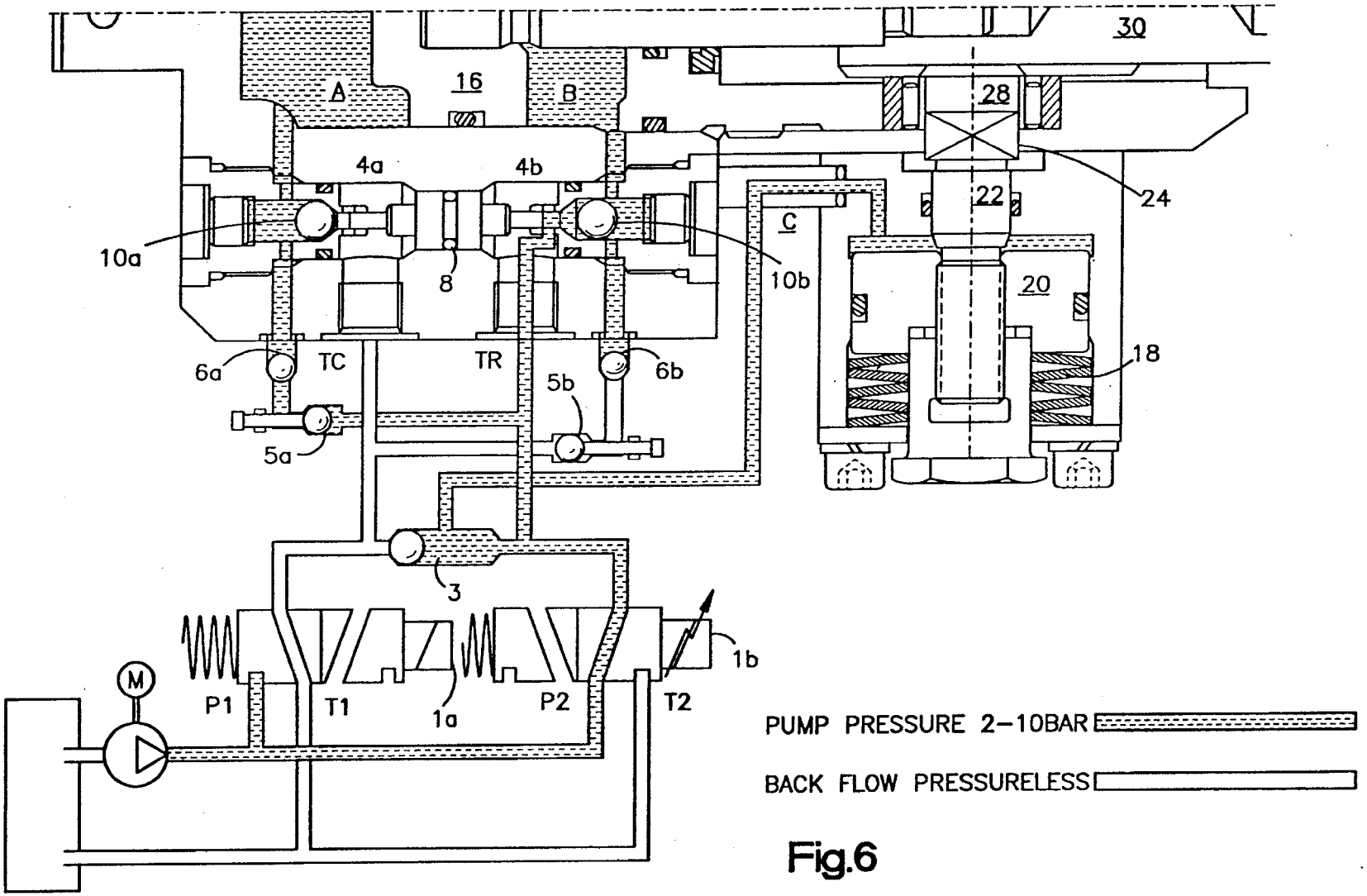
FIGS. 6–9 are cross-sectional side views that illustrate the operational sequence of retracting the main piston.
Figure 7:
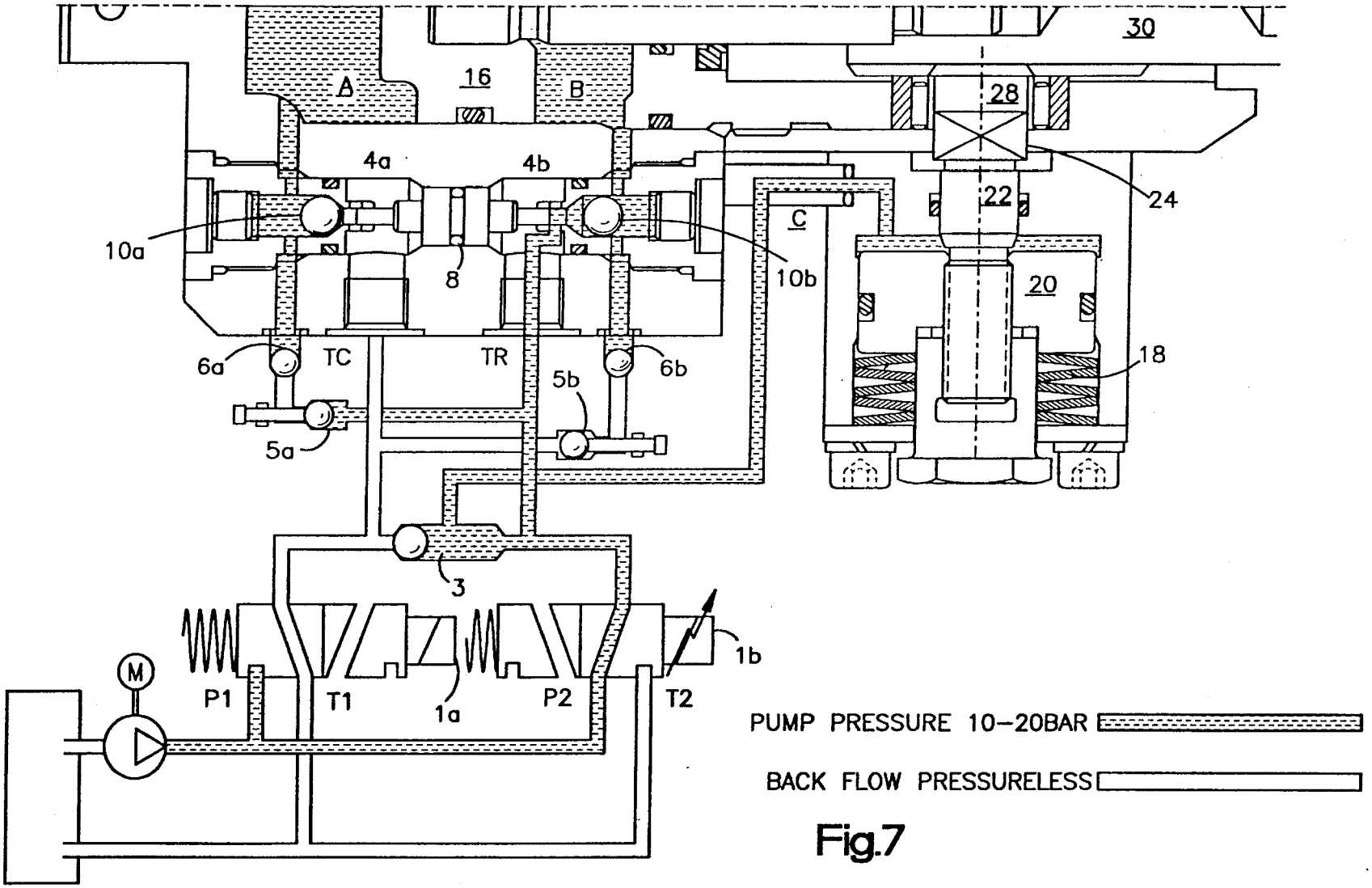
Figure 8:
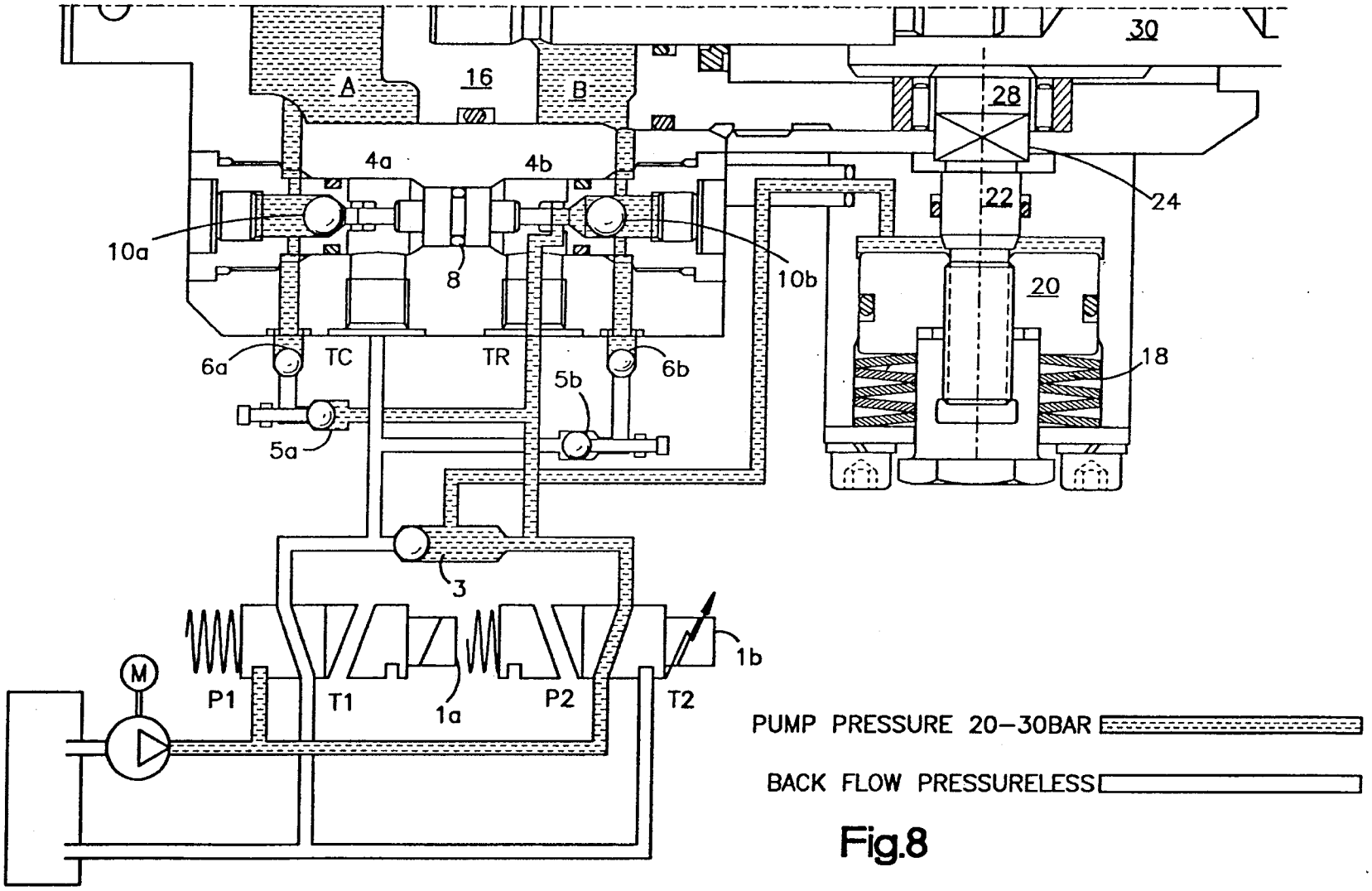
Figure 9:
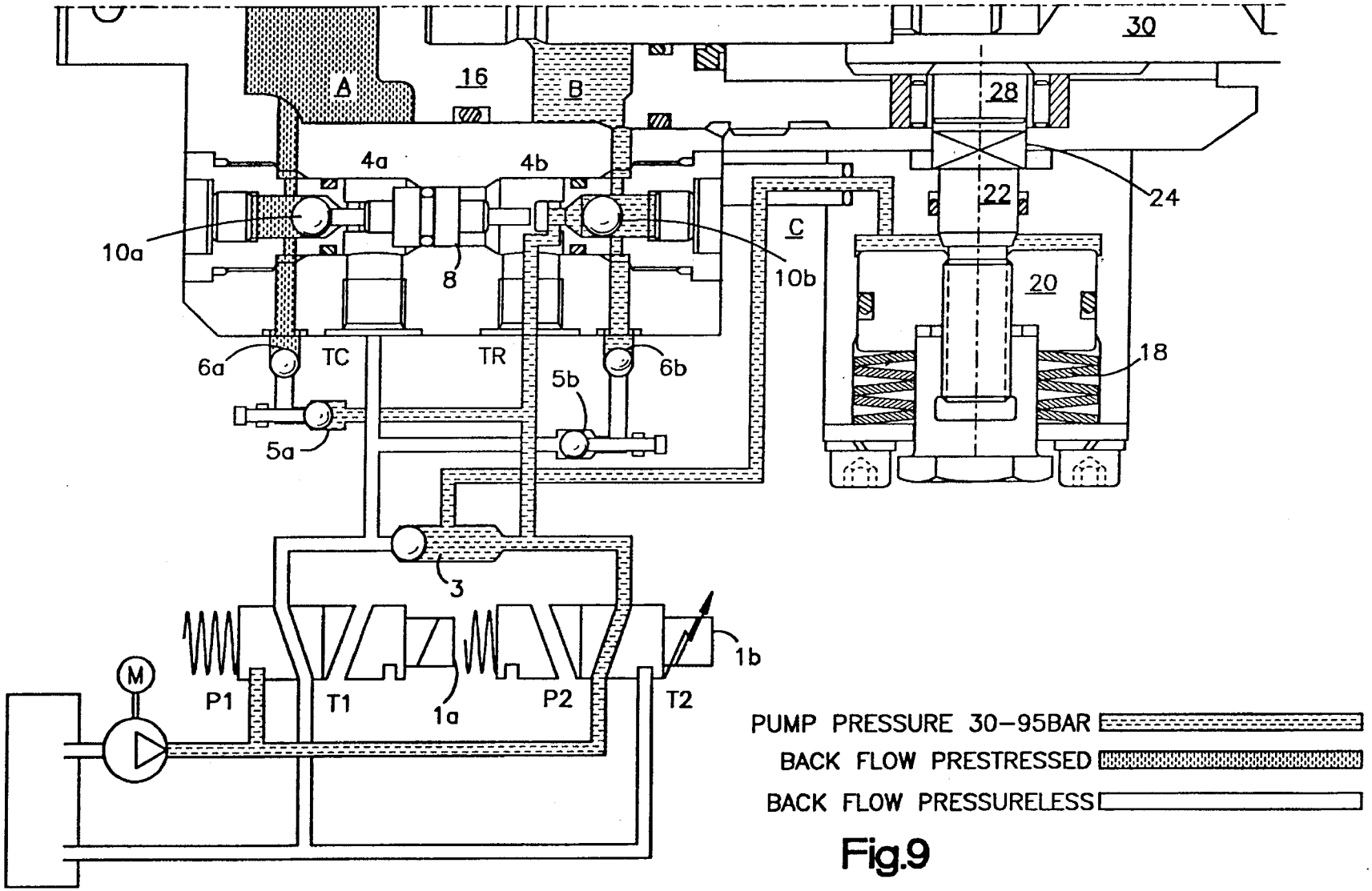

Referring to FIG. 5, the fourth step in extending the main piston begins at approximately 30 bar. Further pressure rise causes the valve piston 8 to open the check valve 10B and allows a restricted flow out of chamber B into the drained TR line. Piston 16 now extends at the speed determined by the pump delivery. Due to the throttling function of the stem of piston 8 in the discharge orifice of the valve cartridge 4B, a counterpressure is built up and maintained in chamber B in front of piston 16 so as to hold the piston firmly between two fluid columns even during its movement.

When the surgical table reaches the desired position, solenoid valve 1A is deactivated, draining the TC line. The check valves 4A/B close immediately and maintain a certain fluid pressure on both sides of main piston 16. In addition, the fluid drains away from piston 20 of the locking device, which is then mechanically urged into position to prevent movement of the main piston rod. The situation of FIG. 1 (neutral position) is again reached.

FIGS. 6–9 illustrate the corresponding operation sequence for the retraction movement. Since the valve system is symmetrical for both directions of main piston movement, the foregoing description of the extension movement applies to the retraction movement as well. The retraction sequence is exactly the same, except that the opposite unit of each valve pair is involved.

Those skilled in the art will appreciate that there are obvious variations suggested by the disclosure. For example, the bias applied to the position locking device could be supplied as well by a coil spring, a pressure activated solenoid, or hydraulically through a supplemental valving arrangement. Although greater mechanical advantage is achieved in the preferred embodiment through the threaded piston rod and mating nut, the same result could be obtained by a direct friction brake against the rod itself. Furthermore, the fluid activated design described herein could be easily modified for pneumatic controls.

The foregoing description of a preferred embodiment and alternative embodiments of the invention have been presented for purposes of illustration and description. The description is not intended to be exhaustive or to limit the invention to the precise form disclosed. Obviously, many modifications and variations are possible in light of the above teaching. The embodiment presented above was chosen and described in order to best explain the principles of the invention and its practical application to thereby enable others skilled in the art to best utilize the invention in various embodiments and with various modifications as are suited to the particular use contemplated.

What is claimed is:

1. A control and position locking device for surgical tables comprising:

a. a piston;

b. a rod connected at one end to said piston, forming a piston-rod assembly, and connected at the other end to said table;

c. a position locking device that arrests the motion of said piston-rod assembly when positively engaged with said piston-rod assembly;

d. a biasing device that urges said position locking device into positive engagement with said piston-rod assembly; and e. a fluid communication path that delivers fluid pressure that acts in opposition to said biasing device and disengages said position locking device from said piston-rod assembly when a predetermined fluid pressure is established on both sides of said piston.

2. A control and position locking device, as described in claim 1, in which said fluid communication path further comprises:

a fluid communication path to both sides of said piston.

3. A control and position locking device, as described in claim 1 or 2, in which said fluid communication path further comprises:

fluid fill valves that interrupt the fluid flow to the downstream side of said piston when a predetermined fluid pressure is reached.

4. A control and position locking device, as described in claim 3, in which said fluid communication path further comprises:

a pressure activated throttling valve that allows fluid to drain away from the downstream side of said piston only at a controlled rate after said biasing device is overcome.

5. A control and position locking device, as described in claim 1, in which said position locking device further comprises:

a. a means for translating the linear motion of said piston into rotational motion with attendant mechanical advantage; and b. a means for arresting said rotational means and thereby preventing further linear motion of said piston.

6. A control and position locking device, as described in claim 5, in which said means for translating linear motion into rotational motion with attendant mechanical advantage further comprises:

a. a threaded shank of said rod in said piston-rod assembly;

b. a nut that mates with said threaded shank; and c. thrust bearings impinging on said nut.

7. A control and position locking device, as described in claim 5, in which said means for arresting rotational motion further comprises:

a. gear teeth machined into the outer periphery of the rotating member; and b. a mating gear section that moves into and out of engagement with said toothed rotating member.

8. A control and position locking device, as described in claim 1, in which said biasing device further comprises:

a spring means for urging said position locking device into positive engagement with said piston-rod assembly.

9. A control and position locking device, as described in claim 1, in which said position locking device further comprises:

a. said piston rod assembly having a threaded piston rod;

b. a nut rotationally engaged with said threaded piston rod and having gear teeth on its outer periphery;

c. a second rod, one end of which terminates in a gear section;

d. a second piston one side of which is attached to other end of said second rod; and e. a spring means that impinges on the other side of said second piston, and urges said second piston, second rod and gear section into positive engagement with said toothed nut.

10. A control and position locking device, as described in claim 1, which further comprises:

a. said piston rod assembly having a threaded piston rod attached to said piston;

b. a nut rotationally engaged with said threaded piston rod and having gear teeth on the outer periphery;

c. thrust bearings that impinge on said toothed nut;

d. a second rod, one end of which terminates in a gear section;

e. a spring means for biasing said gear section into positive engagement with said toothed nut;

f. a second piston attached to the other end of said second rod and impinging on said spring means;

g. fluid communication paths to both sides of said piston;

h. fluid fill valves that interrupt the fluid flow to the downstream side of said piston when a predetermined fluid pressure is reached;

i. a pressure activated throttling valve that allows fluid to drain away from the downstream side of said piston only at a controlled rate;

j. said fluid communication path in communication with the hydraulic system of the piston whereby pressurized hydraulic fluid accumulates and drives said second piston into positive engagement with said spring means, until said spring means is overcome and said gear section is moved out of positive engagement with said toothed nut.

11. A control and position locking device, as described in claim 8, in which said position locking device further comprises:

a. said piston rod assembly having a threaded piston rod;

b. a nut rotationally engaged with said threaded piston rod and having gear teeth on its outer periphery;

c. a second rod, one end of which terminates in a gear section;

d. a second piston one side of which is attached to other end of said second rod; and e. said spring means that impinges on the other side of said second piston, and urges said second piston, second rod and gear section into positive engagement with said toothed nut.

* * * * *